US011767148B2

(12) United States Patent
Adams et al.

(10) Patent No.: US 11,767,148 B2
(45) Date of Patent: Sep. 26, 2023

(54) COLLAPSIBLE VESSEL

(71) Applicant: JOI Limited, Surrey (GB)

(72) Inventors: Nick Adams, Surrey (GB); Tracy Murphy, Surrey (GB)

(73) Assignee: JOI LIMITED, Surrey (GB)

( * ) Notice: Subject to any disclaimer, the term of this patent is extended or adjusted under 35 U.S.C. 154(b) by 67 days.

(21) Appl. No.: 17/277,075

(22) PCT Filed: Sep. 13, 2019

(86) PCT No.: PCT/GB2019/052559
§ 371 (c)(1),
(2) Date: Mar. 17, 2021

(87) PCT Pub. No.: WO2020/058673
PCT Pub. Date: Mar. 26, 2020

(65) Prior Publication Data

US 2022/0081163 A1 Mar. 17, 2022

(30) Foreign Application Priority Data

Sep. 21, 2018 (GB) ..... 1815385

(51) Int. Cl.

| | |
|---|---|
| ***B65D 21/08*** | (2006.01) |
| ***A45F 3/20*** | (2006.01) |
| ***A47G 19/22*** | (2006.01) |
| ***B65D 81/38*** | (2006.01) |

(52) U.S. Cl.
CPC ..... *B65D 21/086* (2013.01); *A45F 3/20* (2013.01); *A47G 19/2272* (2013.01); *A47G 19/2288* (2013.01); *B65D 81/3869* (2013.01); *A45F 2003/205* (2013.01); *A47G 2019/2277* (2013.01)

(58) Field of Classification Search
CPC ..... B65D 21/086; B65D 81/3869; A45F 2003/205; A45F 3/20; A47G 2019/2277; A47G 19/2288; A47G 19/2272
USPC ..... 220/8
See application file for complete search history.

(56) References Cited

U.S. PATENT DOCUMENTS

| | | | |
|---|---|---|---|
| 2010/0308042 | A1 | 12/2010 | Faris |
| 2011/0248037 | A1 | 10/2011 | Fung |
| 2011/0284547 | A1 | 11/2011 | McElligott et al. |
| 2011/0303659 | A1 | 12/2011 | Perlman |
| 2013/0264340 | A1 | 10/2013 | Zens |

(Continued)

OTHER PUBLICATIONS

International Search Report, International Application No. PCT/GB2019/052559 Filing date: Sep. 13, 2019, pp. 1-12.

(Continued)

*Primary Examiner* — John K Fristoe, Jr.
*Assistant Examiner* — Jennifer Castriotta
(74) *Attorney, Agent, or Firm* — Umberg Zipser LLP

(57) ABSTRACT

A collapsible vessel for containing fluid comprises at least two interconnected tubular sections which are configured to move axially with respect to each other upon application of a substantially axial force thereto. The vessel is manipulatable between a collapsed configuration in which the sections are substantially nested to form a tube having a first length and an extended configuration in which the sections form a continuous tube having a second length which is greater than the first length. The vessel comprises locking means configured to be reversibly locked while the vessel is in the extended configuration upon the application of a rotational force to at least one section.

25 Claims, 9 Drawing Sheets

(56) References Cited

U.S. PATENT DOCUMENTS

| | | | |
|---|---|---|---|
| 2014/0332528 | A1 | 11/2014 | Blum et al. |
| 2015/0291309 | A1 | 10/2015 | McGregor |

OTHER PUBLICATIONS

UK IPO Search Report, Application No. GB1815385.8 dated Mar. 7, 2019, pp. 1-5.

COLLAPSIBLE VESSEL

This application is a US national phase application of International Application with serial number PCT/GB2019/052559, filed 13 Sep. 2019, which claims priority to United Kingdom patent application 1815385.8, filed 21 Sep. 2018.

The present invention relates to collapsible vessels, and in particular to collapsible vessels or containers for retaining fluids. The invention is especially concerned with collapsible cups or mugs for containing liquids, such as drinks and beverages (including soup or broth). The invention extends to methods of carrying or storing fluids, such as beverages.

Collapsible containers or vessels are known and are used as a means of retaining liquids, in particular beverages. Such vessels enable convenient storage and travel due to their ability to collapse into a small size to fit into small spaces. While such vessels have been used for a number of years, they suffer from many issues, which limits their effectiveness and use. For example, known collapsible vessels have a tendency to leak by nature of their collapsible design. Furthermore, many vessels are unable to maintain an extended configuration in the event of a small amount of pressure being exerted on the top of the vessel, thereby leading to the vessels collapsing and spilling or at least leaking the liquid that is contained within. Also, the use of collapsible vessels for retaining hot beverages is limited, as it has proven to be challenging to develop a vessel that is both collapsible and insulating such that a user can safely hold the vessel without risk of suffering burns. Indeed, to date, it has not been possible to make a leak-proof collapsible cup out of materials having different thermal expansion properties.

There is therefore a need to provide improved collapsible vessels for retaining fluids. The present invention arises from the inventor's work in trying to overcome the problems associated with the prior art.

According to a first aspect of the invention, there is provided a collapsible vessel for containing fluid, the vessel comprising at least two interconnected tubular sections which are configured to move axially with respect to each other upon application of a substantially axial force thereto, such that the vessel is manipulatable between a collapsed configuration in which the sections are substantially nested to form a tube having a first length and an extended configuration in which the sections form a continuous tube having a second length which is greater than the first length, wherein the vessel comprises locking means configured to be reversibly locked while the vessel is in the extended configuration upon the application of a rotational force to at least one section.

Advantageously, the vessel of the invention provides an elegant solution to transporting a fluid vessel (i.e. a container) in a collapsed configuration, which can be very simply extended out into the extended configuration for containing fluid.

Preferably, the vessel is a bucket, bowl, cup or mug, in which case it may comprise a handle. Most preferably, however, the vessel is a cup or mug.

Preferably, the fluid is liquid. The liquid may be, or may comprise, water. Most preferably, however, the fluid is a drink, beverage or foodstuff, such as soup or broth. The vessel is primarily intended to contain warm or hot drinks, such as coffee or tea.

Thus, the collapsible vessel is a high quality, insulated drinking vessel, which expands and locks in place for drinking, and then collapses down for easy transportation. The locking means ensures that the vessel is held securely in the extended configuration, and allows the sections to be expanded and locked using a very simple quick pull and twist motion.

Preferably, each section comprises an inner wall, which may be metallic or non-metallic, and an outer wall, which may be metallic or non-metallic. Preferably, at least one section comprises a circumferential ring, which provides a seal between the inner wall of one section and the outer wall of an adjacent section, as the vessel is manipulated between the extended and collapsed configurations.

Advantageously, such a double-walled arrangement makes it possible to produce a robust, leak-proof collapsible vessel from materials having different thermal expansion properties. The double-walled nature of the vessel also results in significantly improved thermal insulation characteristics. The inventors believe that this is an important feature of the invention, and is novel in its own right.

As such, according to a second aspect of the invention, there is provided a collapsible vessel for containing fluid, the vessel comprising at least two interconnected tubular sections which are configured to move axially with respect to each other upon application of a substantially axial force thereto, such that the vessel is manipulatable between a collapsed configuration in which the sections are substantially nested to form a tube having a first length and an extended configuration in which the sections form a continuous tube having a second length which is greater than the first length, wherein each section comprises an inner wall and an outer wall, and wherein at least one section comprises a circumferential ring, which provides a seal between the inner wall of one section and the outer wall of an adjacent section, as the vessel is manipulated between the extended and collapsed configurations.

Advantageously, the circumferential ring provides a robust fluid seal to ensure that no fluid leaks when the vessel is in any configuration, thereby improving the safety of the vessel, especially if the fluid is a hot beverage or foodstuff, the thermal effect of which can cause expansions/contractions on the vessel. The seal also serves to control and minimise mutual rotation between adjacent tubular sections as the move between the extended and collapsed configurations.

Preferably, the vessel of the second aspect comprises locking means configured to be reversibly locked while the vessel is in the extended configuration upon the application of a rotational force to at least one section.

Using significant inventive endeavour, the inventors have managed to create a vessel, which is made of an outer stainless steel shell which has been press-fitted to a plastic inner shell with the sections separated by a silicone ring to allow easing opening and closing. Accordingly, preferably the inner wall is substantially non-metallic, for example it may comprise plastic. Preferably, the outer wall is substantially metallic, for example it may comprise steel, more preferably stainless steel.

Preferably, the inner and outer walls are spaced apart, and may be maintained in a spaced apart configuration by means of one or spacing strut disposed therebetween. The or each spacing strut may comprise or be plastic. Preferably, gas (e.g. air) is trapped in between the inner and outer wall of a section. The gas may be present at atmospheric pressure. In a preferred embodiment, the gas is present at a reduced pressure, i.e. a pressure below atmospheric pressure. Advantageously, the vessel is double-walled, which significantly improves temperature control and insulation, such that hot liquids (e.g. hot drinks) retain their heat, whereas cold liquids (e.g. ice cold drinks) remain cool.

Preferably, the sections of the vessel of the first and second aspect are substantially coaxial. Preferably, the vessel comprises at least two, at least three, at least four or at least five interconnected tubular sections. Preferably, the vessel comprises less than ten, nine, eight or seven interconnected sections. Most preferably, however, the vessel comprises two or more sections, and most preferably three sections. In some preferred embodiments, the vessel comprises two sections. In alternative preferred embodiments, the vessel comprises three sections.

Preferably, the sections have different average or mean cross-sectional lengths such, upon application of a substantially axial force thereto, a first section can fit into the second section when the vessel is in the collapsed or partially collapsed configuration. Preferably, the first section is adjacent to the second section. The cross-section of the sections may be of any shape, for example oblong, rectangular, square, triangular or circular. Most preferably, however, the sections have a circular cross-section. Thus, preferably, the sections have different average or mean diameters such, upon application of a substantially axial force thereto, a first section can fit into the second section when in the collapsed or partially collapsed configuration.

Preferably, a first end of the section having the smallest average or mean cross-sectional length is open, and its opposite end is closed or sealed. The closed end preferably forms the base of the section, and therefore the base of the vessel. The cross-section length (i.e. diameter) of the base may be greater than the cross-sectional length (i.e. diameter) of the section have a larger average or mean cross-sectional length in order to improve the stability of the vessel when it is placed down a support surface, such as a table or desk. The underside of the base may comprise or consist of a resilient material, for example silicone or rubber, to further improve stability. Preferably, both ends of the other section are open, such that the smaller section can slide into, and partially through, the larger section.

For example, in one embodiment, the average diameter of a first section may be between about 50 and about 150 mm, more preferably between about 70 mm and about 120 mm, and most preferably between about 80 mm and about 100 mm. The average diameter of a second section may be between about 50 mm and about 110 mm, more preferably between about 60 mm and about 100 mm, and most preferably between about 70 mm and about 90 mm. The average diameter of a third section may be between about 40 and about 100 mm, more preferably between about 50 mm and about 90 mm, and most preferably between about 60 mm and about 80 mm. Preferably, the inner diameter of the vessel, when in the extended configuration, varies along the second length of the continuous tube. Preferably, the inner diameter of the vessel is stepped along the tube, wherein each inner diameter corresponds to each tubular section.

Preferably, the vessel comprises a corresponding number of circumferential rings for the number of tubular sections configured to fit inside adjacent tubular sections. For example, in an embodiment in which the vessel comprises two tubular sections, the vessel preferably comprises at least one circumferential ring disposed between the two sections to create a seal therebetween. In an embodiment, in which the vessel comprises three tubular sections, the vessel preferably comprises at least two circumferential rings, wherein each ring is disposed between a pair of adjacent sections to create seals therebetween, as one fits inside the other. In an embodiment, in which the vessel comprises four tubular sections, the vessel preferably comprises at least three circumferential rings, wherein each ring is disposed between a pair of adjacent sections to create seals therebetween, and so on.

Preferably, the or each circumferential ring is disposed between the inner wall of one tubular section and the outer wall of an adjacent tubular section. Preferably, the or each circumferential ring is disposed in or on an outer wall of a first tubular section and/or in or an inner wall of a second tubular section, or vice versa, wherein the first section is configured to fit inside the second section when the vessel is in the collapsed or partially collapsed configuration, preferably upon application of a substantially axial force thereto. Advantageously, the or each circumferential ring facilitates opening and closing of the vessel between the extended and collapsed configurations, preventing mutual rotation between the connecting tubular sections, and also prevents fluid leakages.

Preferably, the or each circumferential ring is disposed on or in an outer wall of each section configured to fit inside an adjacent section. In one embodiment, the or each ring may be attached to the section by adhesive. In another embodiment, an inner surface of the circumferential ring is disposed in a correspondingly shaped slot disposed in an outer wall of the section, thereby leaving an exposed surface of the ring which is configured to abut the inner wall of the adjacent section. The exposed surface of the ring may comprise a circumferentially extending groove, preferably flanked on one or both sides by a circumferentially extending ridge. Advantageously, the ridges either side of the groove on the ring provide a robust double seal between adjacent sections at all times. Preferably, the circumferential ring comprises or consists of a resilient material, for example silicone or rubber.

Preferably, the vessel comprises a removable lid, which can be releasably attached to the open end of the section having the larger average or mean cross-sectional length. Preferably, the inner diameter of the lid is substantially the same as the outer diameter of the section with which is engages. The lid may attached to the section using a friction fit or screw thread. Preferably, the lid comprises an aperture through which fluid may flow, and a stopper, which is mounted about a pivot, and configured to move between a first position in which the aperture is blocked and a second position in which the aperture is unblocked.

Preferably, the vessel comprises guide means configured to indicate when the locking means is either engaged or disengaged. Preferably, the guide means is disposed on one or more of the sections, such that when the guide means on adjacent sections are aligned, they indicate that the locking means is engaged. The guide means may be a marking, such as a line, arrow, dot, circle, notch, star, or other suitable mark.

Preferably, the locking means comprises one or more first locking members disposed on a first section, and one or more second locking members disposed on a corresponding location on an adjacent section, wherein the or each first locking member is configured to engage with the or each second locking members, to thereby lock the sections in the extended configuration, preferably upon application of a substantially rotational force to at least one section, more preferably upon application of opposing rotational forces to each section. The first locking member may be described as a "female member", and the second locking member may be described as a "male member". Preferably, the or each first and second locking members are configured to be disengaged from each other to unlock the sections upon application of a substantially rotational force in an opposite direction to that applied for locking to at least one section, more preferably upon application of opposing rotational forces to each section, most preferably in opposite directions to those applied for locking.

Preferably, the or each first locking member comprises a first moulding, which is attached to, and extends partially around the circumference of the lowermost portion of an inner facing surface of the section to which it is attached. The first moulding preferably extends along a short arc along the inner circumference of the section to which it is attached. Preferably, the locking means comprises a plurality of first locking members, wherein each one is circumferentially spaced apart along the circumference of the section. Preferably, the locking means comprises at least two, at least three, or at least four spaced apart first locking members, and a corresponding number of second locking members. Advantageously, the or each corresponding second locking member may pass between spaces disposed between the or each first locking members, as the vessel is axially converted between the collapsed and extended configurations. Preferably, the locking means comprises four spaced apart mouldings disposed at about 90° with respect to each other along the circumference of the section to which they are attached.

Preferably, the or each first moulding comprises a body section from which extends an elongate overhanging finger. Preferably, the overhanging finger tapers radially inwardly to form a small recess, and tapers radially outwardly to create a terminal lug. Preferably, an elongate slot extends partially around the circumference of the lowermost portion of the inner facing surface of the section to which the first moulding is attached, and is adjacent to, and substantially parallel with, the overhanging finger.

Preferably, the or each second locking member comprises a second moulding, which is attached to, and extends partially around the circumference of the uppermost portion of the outer facing surface of the section to which it is attached. Preferably, the locking means comprises a plurality of second locking members, wherein each one is spaced apart along the circumference of the section to which they are attached. Preferably, the locking means comprises at least two, at least three, or at least four spaced apart second locking members. Preferably, the locking means comprises four spaced apart second mouldings disposed at about 90° with respect to each other along the circumference of the section.

Preferably, the circumferential ring is disposed spaced apart and above the second moulding, thereby creating a space therebetween. Preferably, adjacent to the space, and circumferentially therealong, the or each second locking member comprises a protrusion, over which the lug of the or each first locking member can pass until it reaches, and is received by, the space. When the lug is received by the space, the second moulding is preferably received by the slot under the overhanging finger, and the or each first locking member and the or each second locking member preferably mutually engage with each other, thereby locking the sections together.

Preferably, at least two sections are configured to separate until the underside of the circumferential ring abuts the first moulding. In embodiments of the vessel have more than two tubular sections, they are preferably configured to separate until the underside of each circumferential ring on one section abuts the first moulding on its adjacent section. Advantageously, the circumferential ring controls rotation of the sections, and, once the female and male locking members are engaged with one another, the ring forms a tight seal between adjacent sections by contacting the second moulding and the lug.

The locking members may be disengaged by moving the lug out of the slot and back over the protrusion. It will be appreciated that the first and second locking members (i.e. mouldings) may be disposed on the opposite sections to those described herein. In other words, the male and female components can be swapped over.

The inventors have demonstrated that the vessels of the invention can be used to contain fluid, preferably liquid, such as a drink.

In a third aspect, there is provided use of the vessel of either the first or second aspect to contain fluid.

In a fourth aspect, there is provided a method of containing fluid, the method comprising inserting fluid into the vessel of the first or second aspect.

When the vessel of the first or second aspect is in the collapsed configuration, the method may comprise removing the stopper on the lid to allow air to flow through the aperture during the extension process. It should be appreciated that if the stopper is not taken off the aperture, a partial vacuum may be created making it harder to axially pull the vessel apart into the extended, or partially extended configuration. The method may comprise applying a rotational force to first and second sections, such that the or each first locking member and the or each second locking member are mutually arranged such that they do not engage with each other. This may be achieved by twisting the first and second sections to arrange the or each second moulding of the second locking member such that it is not in axial alignment with the or each first moulding of the first locking member. Instead, the or each second moulding is axially aligned with the spaces between the or each first moulding.

The method preferably comprises applying an axial force to the sections, thereby pulling them apart. The spaced apart axial alignment of the or each first and second locking members means that they do not abut and interfere with each other under application of the axial force, thereby allowing the sections to be axially pulled apart. The sections slide apart to mutually separate until the underside of circumferential ring on one section abuts the top of the first moulding on an adjacent section. The vessel is now in the fully extended configuration, but is still unlocked, and so the method preferably comprises engaging the locking members to prevent unwanted collapse.

Once the sections have been axially separated, the method preferably comprises applying opposing rotational forces on the sections, thereby urging the or each first and second locking members to mutually engage. The method preferably comprises urging the overhanging finger of the or each first locking member into the space between the circumferential ring and the second moulding, such that the terminal lug is urged over protrusion of the or each second locking member until the protrusion is received by, and engages with, recess of the or each first locking member.

Preferably, the method comprises aligning guide means on the side of each section to denote when the locking members have engaged with each other. The circumferential ring acts to control rotation and, once the locking members are engaged with one another, the ring forms a tight seal between adjacent sections by contacting the first moulding and the lug.

Once the vessel has been extended, the method comprises removing the lid and filling the vessel with the desired liquid. Once the user has finished with the fluid (e.g. drinking), and wishes to collapse the vessel for transport, the method may comprise rotating each section in the opposite direction than when locking, such that second moulding is rotated out of the slot, and is aligned with the recess, and the lug portion is disengaged from the space. Accordingly, the or each first and second locking members are preferably disengaged from one another. The guide means helps the user to know when the locking members are disengaged from each other.

All of the features described herein (including any accompanying claims, abstract and drawings), and/or all of the steps of any method or process so disclosed, may be combined with any of the above aspects in any combination, except combinations where at least some of such features and/or steps are mutually exclusive.

For a better understanding of the invention, and to show how embodiments of the same may be carried into effect, reference will now be made, by way of example, to the accompanying Figures, in which.

Figure 4A:
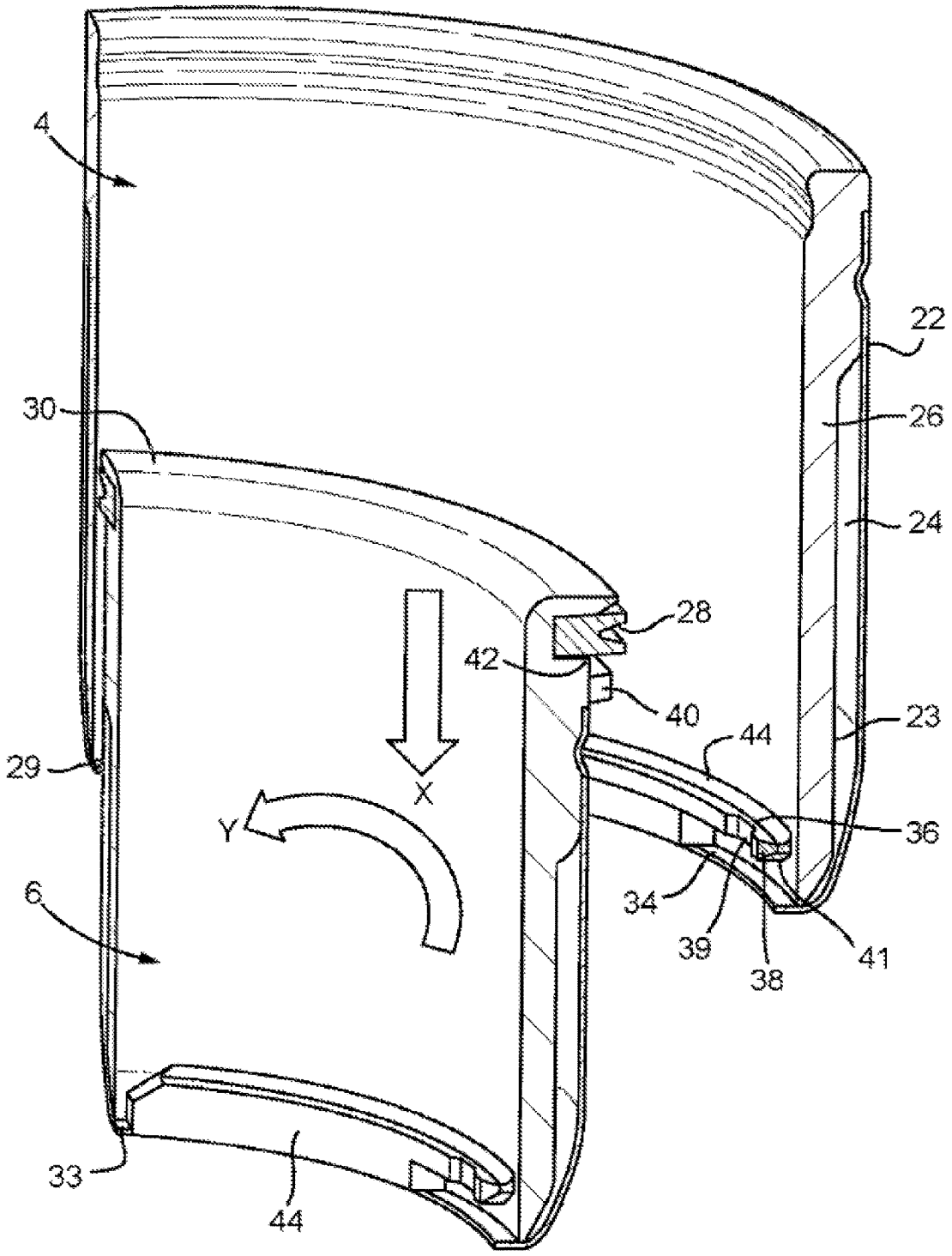
Figure 4B:
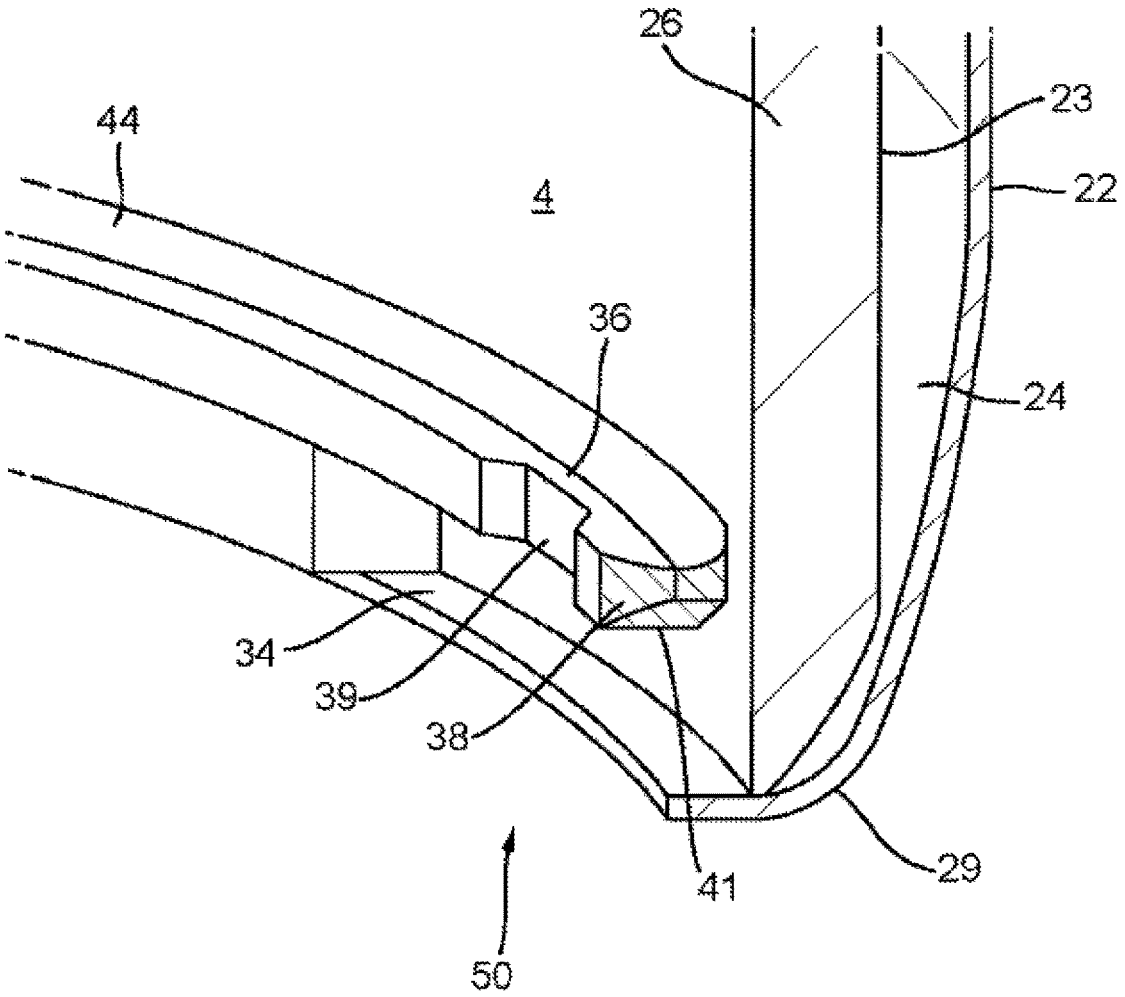

FIG. 4*a* is a partial cross-sectional perspective view of the vessel as viewed internally and showing components of a locking system, and FIG. 4*b* is an enlarged internal view of a "male" component of the locking system shown in FIG. 4*a;*

Figure 5A:
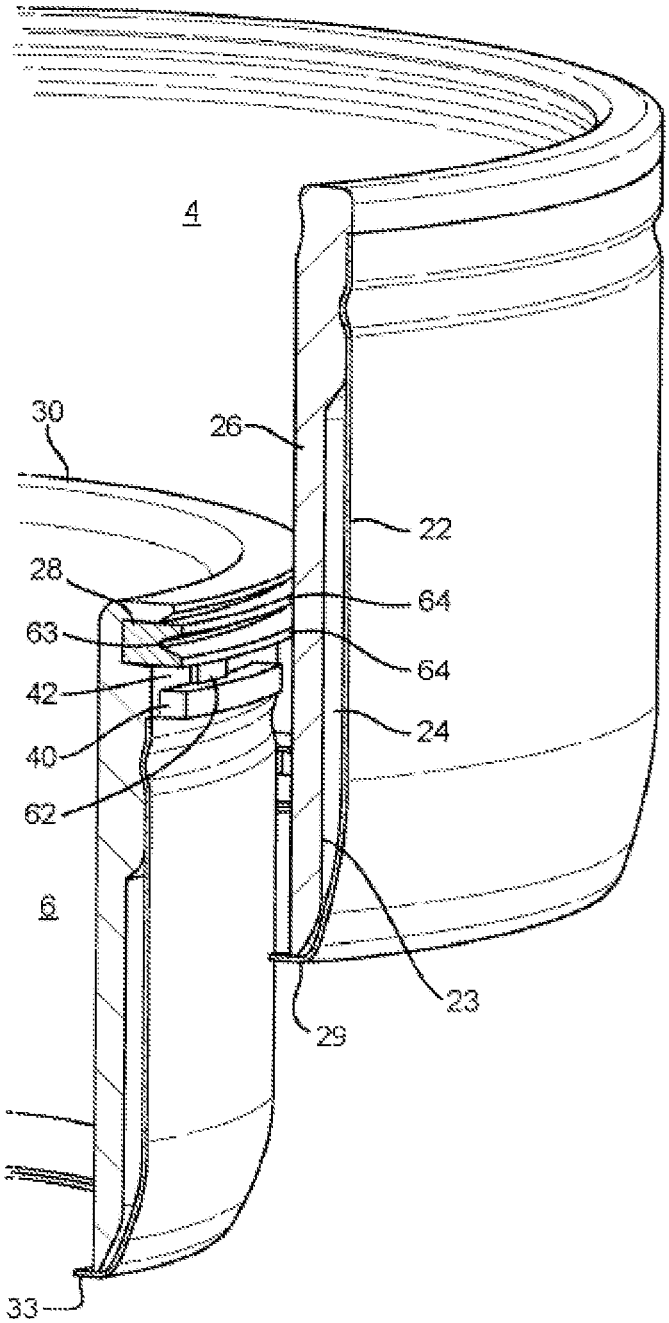
Figure 5B:
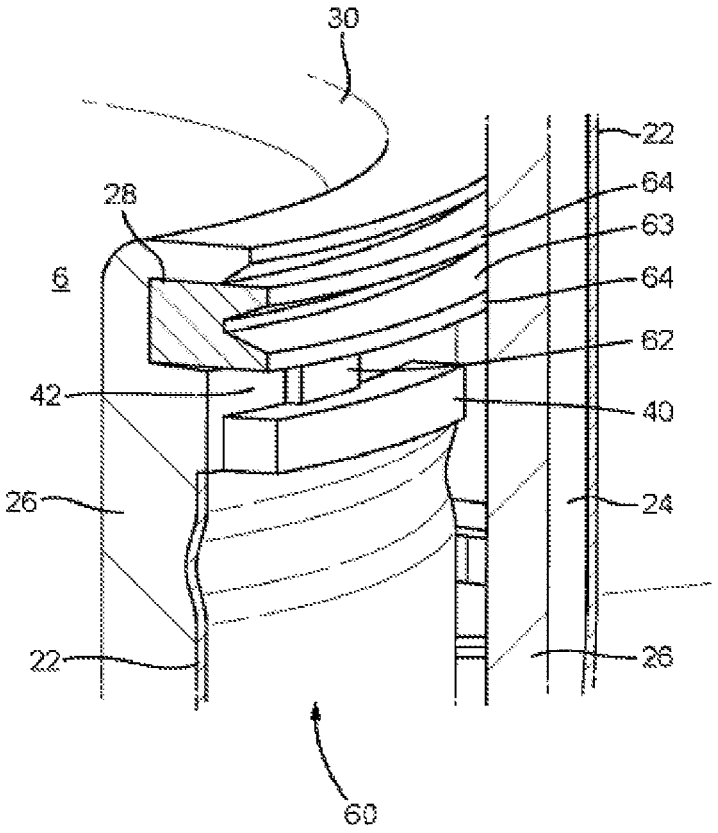

FIG. 5*a* is a partial cross-sectional perspective view of the vessel as viewed externally and showing components of the locking system, and FIG. 5*b* is an enlarged external view of a "female" component of the locking system shown in FIG. 5*a;*

Figure 6:
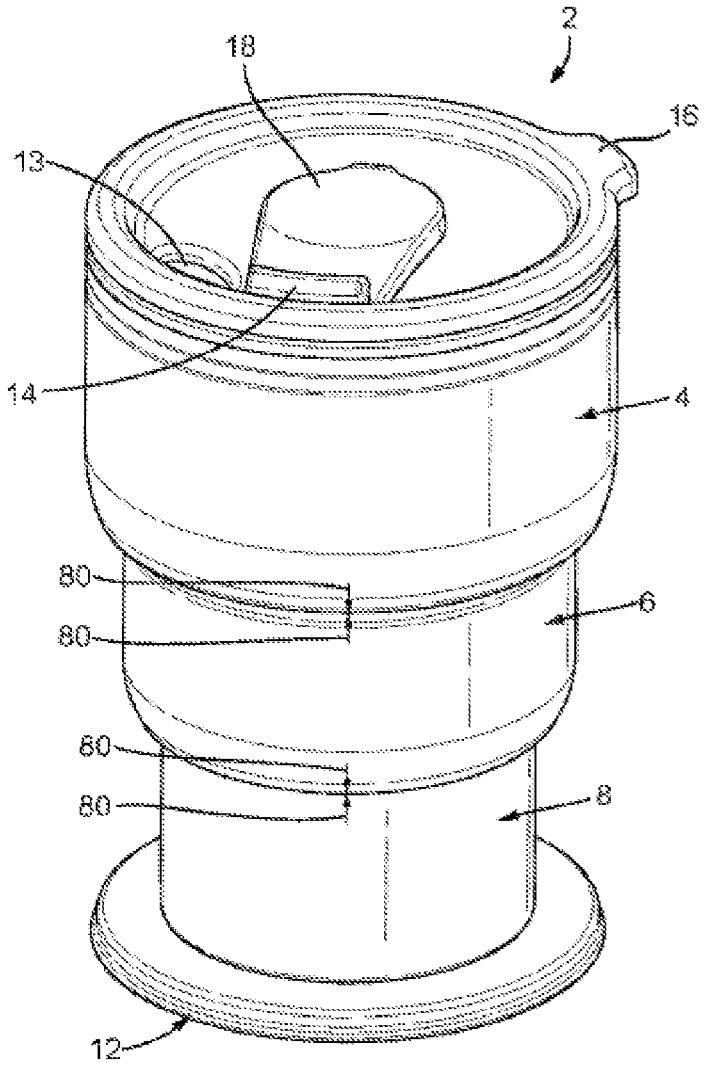
Figure 7:
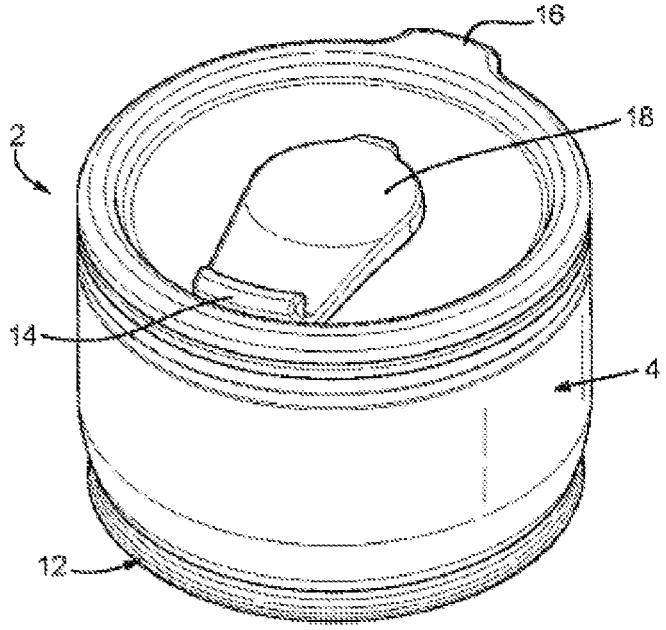
Figure 8:
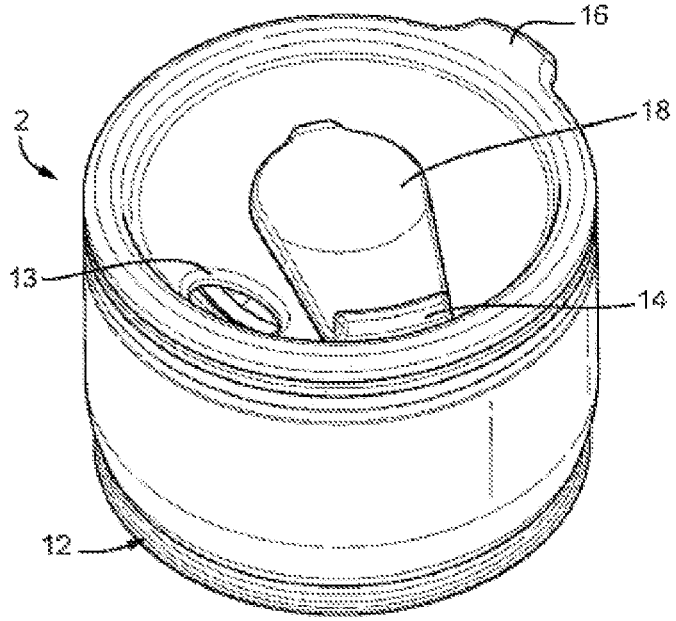
Figure 9:
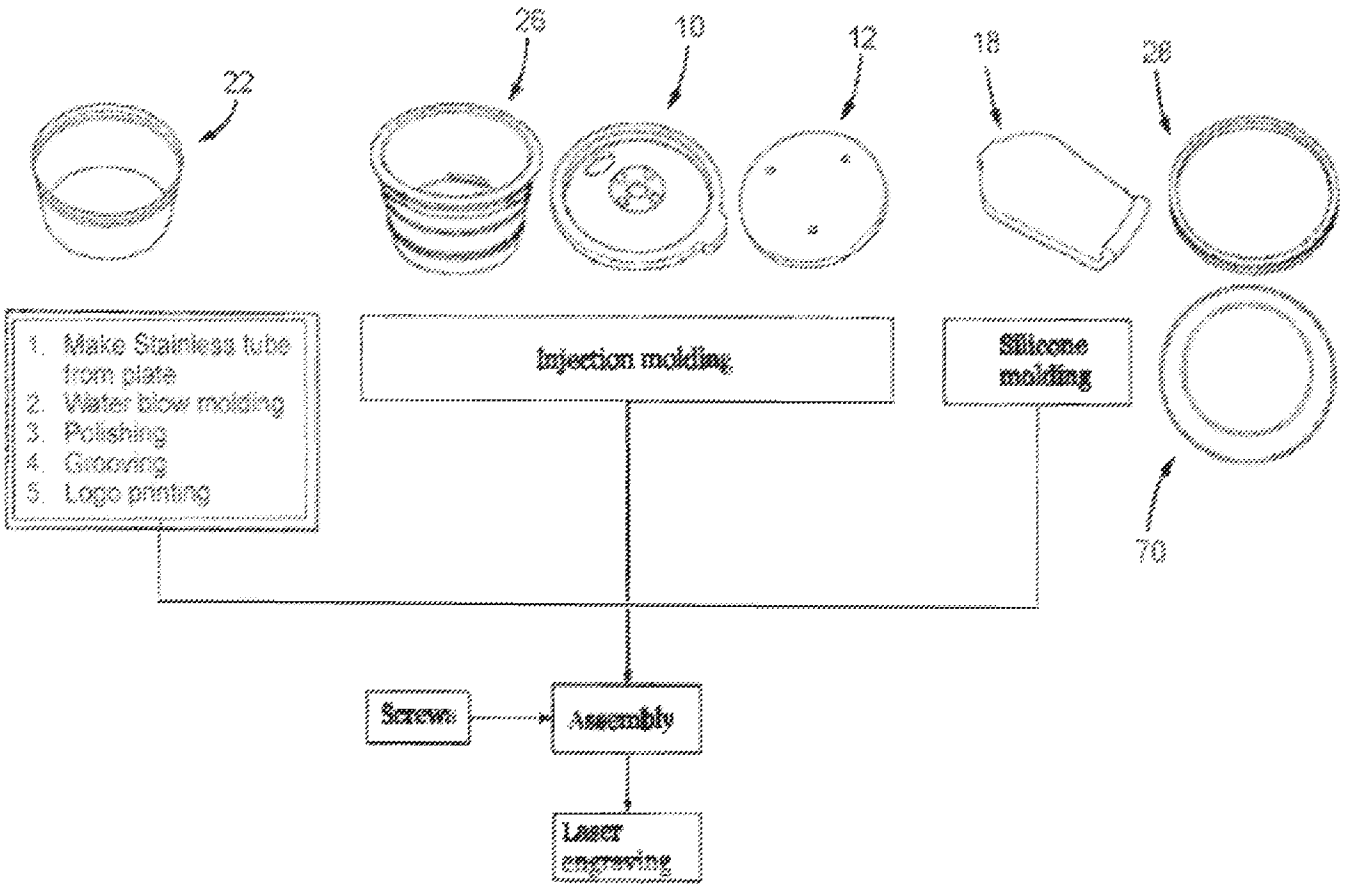

FIG. 6 is an alternative perspective view of the vessel shown in the extended configuration with the three sections separated and with a drinking aperture open;

FIG. 7 is an alternative perspective view of the vessel shown in the collapsed configuration with a drinking aperture closed;

FIG. 8 is an alternative perspective view of the vessel shown in the collapsed configuration with the drinking aperture open; and FIG. 9 shows the manufacturing process of the vessel.

EXAMPLE

Referring to the Figures, there is shown an embodiment of a collapsible vessel or container 2, for use in holding or retaining a fluid. The vessel 2 can, in one embodiment, be a cup or mug (and therefore have a handle—not shown), and therefore be used to hold a drink, for example a cold beverage. However, the materials used to manufacture the vessel 2 make it especially suitable for holding hot drinks, or hot soup or broth or the like, without the risk of injuring the user who is holding it. In another embodiment, the vessel 2 may be arranged to hold other fluids or liquids, for example the vessel 2 could be a bucket, or a washing up bowl etc. Indeed, the vessel 2 can carry any fluid, and be of any shape (e.g. square or rectangular) or size, as long as it is collapsible, and is useful when it needs to be transported.

Figure 1:
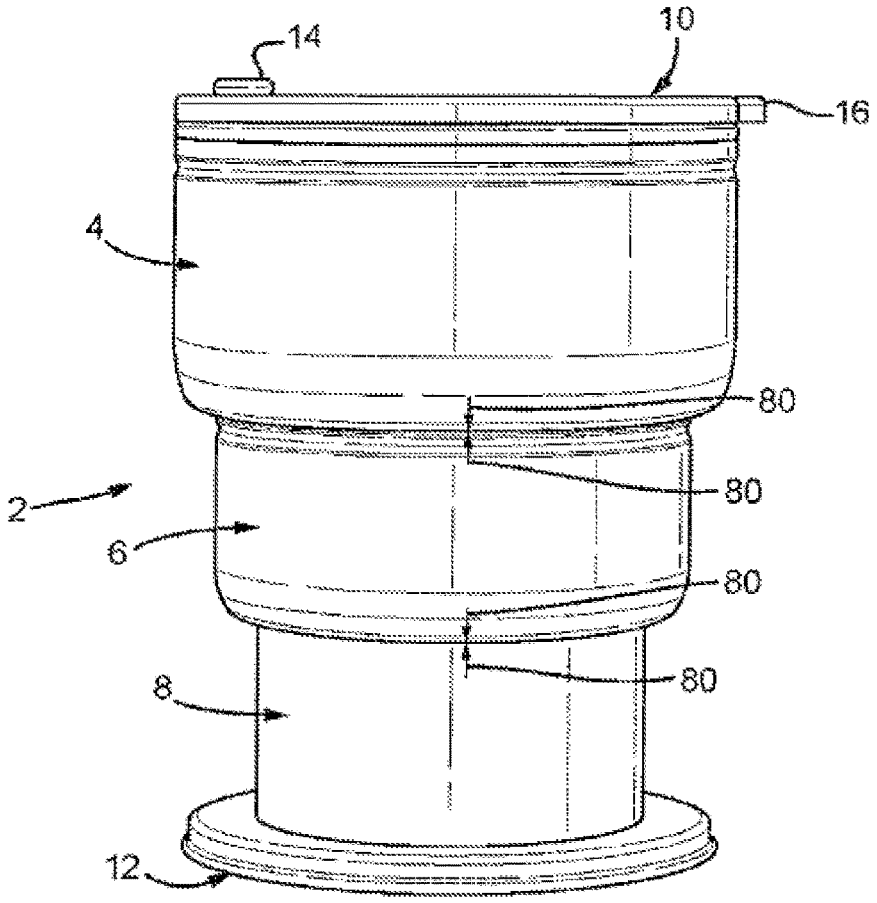
FIG. 1 is a perspective view of an embodiment of a collapsible vessel for carrying fluid having three sections shown in an extended configuration.
Figure 2:
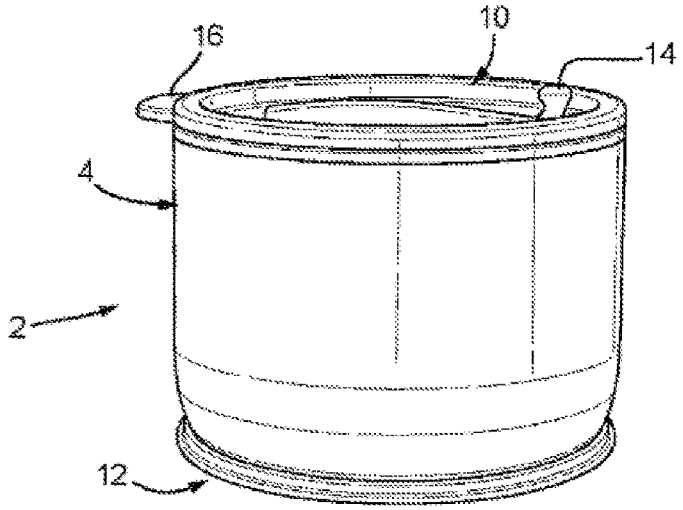
FIG. 2 is a perspective view of the embodiment of the vessel shown in a collapsed (or "transportation") configuration with all three sections nested together.
Figure 3:
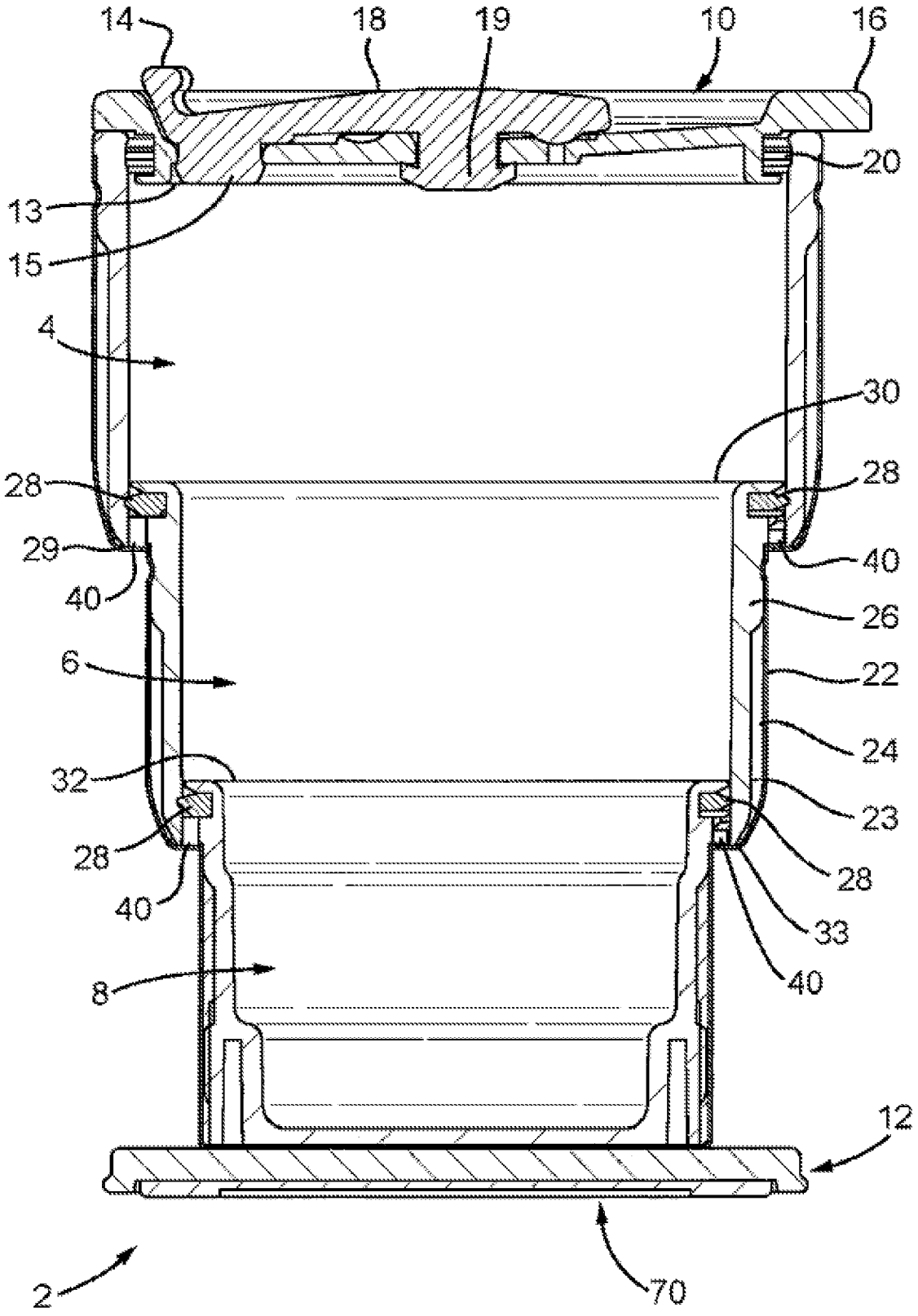
FIG. 3 is a cross-sectional side view of the vessel shown in the extended (or "fluid is containing") configuration with all three sections extended from one another.

Referring to FIGS. 1, 3 and 6, the vessel 2 is shown in an extended configuration, and it is in this configuration that fluid (e.g. a liquid drink or soup etc.) can be contained. As shown and described in relation to FIGS. 4*a*, 4*b*, 5*a*, and 5*b*, the vessel includes a number of elegant locking systems 50, 60, which, as is described in detail below, releasably secure the vessel 2 in the extended configuration, and prevents unwanted collapse. FIGS. 2, 7 and 8, on the other hand, show the vessel 2 in a collapsed configuration, and it is in this configuration that the vessel 2 takes up less space and so is easily transportable, because it is simpler to carry in a user's pocket, bag or the like. However, it will be appreciated that a smaller volume of fluid could still be contained in the vessel 2 when it is in the collapsed configuration, as shown in FIG. 2.

As shown in FIGS. 1, 3 and 6, the vessel 2 has a circular cross-section, having three moveable coaxial cylindrical sections or tubes, 4, 6 and 8, which nest together to define an inner cavity for retaining liquid therein. The sections are circular in cross-section, but of varying diameters such that section 4 has a greater diameter than section 6, which in turn has a greater diameter than section 8. As such, section 8 is able to fit inside section 6, which can fit inside section 8, and thereby collapse down into the collapsed configuration shown in FIGS. 2, 7 and 8.

FIG. 3 shows that sections 4, 6 and 8 of the vessel 2 each comprise a double walled structure, having an outer stainless steel shell 22 attached to an inner plastic shell 26 by spacer struts 23, and defining an air gap 24 therebetween. This double-walled arrangement significantly improves not only the thermal insulation properties of the vessel 2 (as it is possible to produce a robust, leak-proof collapsible vessel from materials having different thermal expansion properties), but also its aesthetic appeal, and means that it is possible to embellish the outer wall 22 with attractive branding.

As can be seen clearly in FIG. 1, the outer wall of top section 4 tapers radially inwardly to meet the outer wall of the middle section 6, which in turn tapers radially inwardly to meet the outer wall of the bottom section 8. The outer diameter of section 4 is 90 mm, the inner diameter is 82 mm, and its length is 52 mm. The outer diameter of section 6 is 80 mm, the inner diameter is 68 mm, and its length is 45 mm. The outer diameter of section 8 is 67 mm, the inner diameter is 63 mm, and its length is 45 mm. The total length (i.e. height) of the vessel 2 when in the extended configuration shown in FIG. 1 is approximately 136.5 mm.

One end of the smallest section 8 is open, whereas the opposite end is closed and has a base 12 attached thereto. The diameter of the base 12 is greater than the diameter of section 8 (and also section 6) in order to improve the stability of the vessel 2 when it is placed down a support surface, such as a table or desk. The underside of the base 12 has a silicone base grip 70 to further improve stability. Both ends of the cylindrical section 6 and also section 4 are open, with section 8 being able to slide into, and partially through, section 6, and second 6 being able to slide into, and partially through, section 4.

Vessel 2 has a removable lid 10 which can be releasably attached to the open end of section 4, which is distal to the base 12, as shown in FIGS. 1 and 2. This allows for liquids to be poured into the vessel 2 and then subsequently closed with the lid 10, stopping any liquid that is retained within the vessel 2 from being spilled. The outer diameter of the lid 10 is generally the same as that of section 4, except for a small lip 16 on one side that overhangs section 4 when the lid 10 is engaged therewith, to enable easy removal of the lid 10. The lid 10 has an inner section 20 which has a smaller diameter than section 4 and which is fitted with a silicone moulding, such that when the lid 10 is engaged with section 4, a tight seal is created that is impermeable to liquids. Instead of using a friction fit as shown in the illustrated embodiment, in an alternative embodiment, the lid 10 and upper inner surface of section 4 is provided with a screw thread, such that the lid 10 can be screwed tightly onto section 4.

The lid 10 comprises a flexible silicone stopper 18 that is flexibly mounted about a pivot 19 and which includes a plug 15 which is capable of sealing a small aperture 13 present in the lid 10. An upper portion of the stopper 18 comprises a flange 14 to enable a user to lift and move the stopper 18 from a first position in which the plug 15 is inserted in the aperture 13 to ensure liquid is retained in the vessel 2 (as shown in FIG. 7), and a second position in which the aperture is revealed to permit the user to drink from the vessel 2 (as shown in FIGS. 8 and 9).

As shown in FIG. 3, a first silicone O-ring 28 extends circumferentially around the top 30 of section 6, and a second silicone O-ring 28 extends circumferentially around the top 32 of section 8. Sections 4 and 6, and sections 6 and 8 are each separated by one of the silicone rings 28. FIG. 5*b* shows the silicone ring on section 6 most clearly. It can be seen that inner surface of the ring 28 is tightly fitted into a correspondingly shaped slot which has been cut out of section 6, leaving an exposed surface which is provided with a circumferentially extending slot 63 flanked either side by a circumferentially extending ridge 64. The two silicone rings 28 enable ease of opening and closing the vessel 2 between the extended and collapsed configurations, and also prevent fluid leakages. In particular, the two ridges 64 provide a robust double seal between adjacent sections. When the vessel 2 is extended, top 30 of section 6 is disposed above base 29 of section 4, and top 32 of section 8 is disposed above base 33 of section 6. FIGS. 2, 7 and 8 show the same embodiment of the collapsible vessel 2 in the collapsed configuration. In the collapsed configuration, only section 4 is visible, because the smaller and medium diameter sections 6 and 8 are wholly contained within larger section 4.

Referring to FIGS. 4*a* & 4*b* and 5*a* & 5*b*, there are shown components of a locking system 50, 60 which is provided on the vessel 2 to secure the various sections 4, 6, 8 together when in the extended configuration to prevent unwanted vessel 2 collapse and leaks, but which is also designed to easily disengage, and allow the sections 4, 6, 8 to slide with respect to each other when moving between the extended and collapsed configurations. Each locking system comprises a "female" component 50, and a "male" component 60, which are disposed on corresponding locations on opposing sides of sections 4 and 6, and also on opposing sides of sections 6 and 8, and which mutually engage to lock and unlock these sections. FIG. 4*b* shows an enlarged view of the first ("female") component 50 of the locking system shown in FIG. 4*a*, and FIG. 5*b* shows an enlarged view of the second ("male") component 60 shown in FIG. 5*a*. As can be seen in FIGS. 4*a* and 4*b*, the first ("female") component of the locking system 50 comprises an elongate rigid plastic moulding 44, which is attached to, and extends partially around the circumference of the lowermost portion of the inner facing surface of the cylindrical section 4. The moulding 44 therefore extends along a short arc along the inner circumference of section 4. Section 6 also includes a similar moulding 44 which extends along a short arc along the inner circumference of section 6.

Although the figures only show one locking system 50, 60, and therefore only one moulding 44, it should be appreciated that there are in fact four mutually engaging locking systems 50,60 on sections 4 and 6, and another four mutually engaging locking systems 50,60 on sections 6 and 8. Accordingly, there are four spaced apart mouldings 44 disposed at 90° with respect to each other along the circumference of each of sections 4 and 6. Each elongate moulding 44 is approximately 5 mm thick, and about 35 mm long. At one end, each moulding 44 splits into (approximately) upper half to create an elongate overhanging finger 36, which tapers radially inwardly to form a small recess 39, and which then tapers radially outwardly to create a terminal lug 38. Disposed circumferentially adjacent to the lug 38 and between adjacent mouldings 44 on the same section, there is provided a space 41 through which the corresponding male component 60 may pass, as described below, as the vessel 2 is moved between the collapsed and extended configurations. An elongate slot 34 extends partially around the circumference of the lowermost portion of the inner facing surface of the cylindrical section 4, and is adjacent to, and parallel with, the overhanging finger 36. The overhanging finger 36 is disposed further away from the top of section 6 than the slot 34.

Referring now to FIGS. 5*a* and 5*b*, the second ("male") component of the locking system 60 includes a plastic or silicone moulding 40, which is attached to, and extends partially around the circumference of the uppermost portion of the outer facing surface of the cylindrical section 6. Section 8 also includes a similar moulding 40 attached thereto its outer surface. As mentioned above, there are four mutually engaging locking systems 50, 60 on sections 4 and 6, and another four mutually engaging locking systems 50, 60 on sections 6 and 8, and so there are four spaced apart "male" mouldings 40 disposed at 90° with respect to each other along the circumference of each of sections 6 and 8.

The circumferentially extending silicone ring 28 is disposed spaced apart and above the mouldings 40, thereby creating a space 42 therebetween. Adjacent to the space 42, and circumferentially therealong, there is provided a protrusion 62, over which the lug 38 of the first component of the locking system 50 can pass until it reaches, and is received by, the space 42. When the lug 38 is received by the space 42, the moulding 40 is received by slot 34 under finger 36. Insodoing, the female component 5*o* and male component 60 of the locking system mutually engage with each other, thereby locking the sections 4, 6, 8 together. The components 50, 60 may be disengaged by moving the lug 38 out of the slot 42 and back over the protrusion 62. The following section will now describe how a user extends the vessel 2 from the collapsed configuration (shown in FIG. 2) to the extended configuration (shown in FIG. 3), and back again to the collapsed configuration.

When the vessel 2 is in the collapsed configuration, the user first removes the stopper 18 on lid 10 to allow air to flow through aperture 13 during the extension process. If the stopper 18 is not taken off aperture 13, a partial vacuum may be created making it harder to pull the vessel 2 apart. Then, the user applies a rotational force to the base 12 and the upper cylindrical section 4, such that the first and second components of the locking system 50, 60, respectively, are mutually arranged such that they do not engage with each other. This is achieved by twisting (in the opposite direction to arrow Y shown in FIG. 4*a*) the base 12 and section 4 to arrange the mouldings 40 of the male components 60 such that it is not in axial alignment with the finger 36 of the female component 50. Instead, the mouldings 4*o* are axially aligned with the spaces 41 between each moulding 44, as shown in FIG. 4*b*. Accordingly, when viewed from above (and along the elongate axis of the vessel 2) the position of the arc created by the finger 36 does not correspond to the position of the arc created by the moulding 40.

The user then grips the base 12 and the upper cylindrical section 4, and applies an axial force (in the opposite direction to arrow X), thereby pulling them apart. The spaced apart axial alignment of the finger 36 and the mounting 40, as described above, means that they do not abut and interfere with each other under application of the axial force, thereby allowing sections 4, 6 and 8 to be axially separated. The sections 4, 6 slide apart to separate until the underside of silicone ring 28 on section 6 abuts the top of moulding 44 on section 4. Similarly, sections 6 and 8 slide apart to separate until the underside of silicone ring 28 on section 8 abuts the top of moulding 44 on section 6. The vessel is now in the full extended configuration, but still unlocked, and so the locking system 50, 60 must be engaged to prevent collapse.

Once the sections 4, 6 and 8 have been axially separated, the user now applies opposing rotational forces on sections 4 and 6, in the direction of arrow Y in FIG. 4*a*, thereby urging the finger 36 of female locking component 50 into space 42 such that the terminal lug 38 is urged over protrusion 62 of the male component 60 until the protrusion 62 is received by, and engages with, recess 39 of the female locking component 50. As shown in FIGS. 1 and 6, the sides of each section 4, 6, 8 includes a guide mark 80 (for example a short straight line, or an arrow, or a dot etc.), which align with each other to signify when the female and male components 50, 60 are engaged with each other. The circumferentially extending silicone ring 28 acts to control rotation and, once the female and male locking components 50, 60 are engaged with one another, the ring 28 forms a tight seal between adjacent sections by contacting the moulding 44 and lug 38.

Once the vessel 2 has been extended, the user can remove the lid 10 by applying an upwards force from section 4 to lip 16, and fill the vessel 2 with the desired liquid. The user can then replace the lid 10 to seal the liquid within the vessel 2. To access the liquid for drinking, the user applies an upward force to flange 14 on the stopper 18 to reveal the small aperture 13 and rotate the stopper 18 about the rotatable pivot 19 to enable the user to access the liquid through the aperture 13.

Once the user has finished drinking, and wishes to collapse the vessel 2, they rotate each section 4, 6, 8 in the opposite direction than when locking, such that moulding 40 is rotated out of slot 34, and is aligned with recess 41, and the lug portion 38 is disengaged from the space 42. Accordingly, the female and male components of the locking system 50, 60 are disengaged from one another. The guide marks 80 help the user to know when the female and male components 50, 60 are disengaged from each other. A force is then applied in the direction of the top of section 4 (arrow X in FIG. 4*a*) towards the base 12 to collapse the vessel 2.

Referring to FIG. 9, there is shown the process used to manufacture the vessel 2 of the invention. Sections 4, 6, 8 each consist of a stainless steel tube 22 made from plate metal, which are then water blow moulded into shape, and polished. Appropriate grooves are provided and then any branding/logos are printed thereon. The inner plastic shells 26, lid 10 and base 12 are injection moulded, and the stopper 18, rings 28 and base grip 70 are silicone moulded.

Advantages of the vessel 2 reside in it provides an elegant solution to transporting a fluid container in a collapsed configuration, which can be very simply extended out into an expanded configuration for containing fluid. The double-walled "on the go" collapsible vessel 2 is a quality insulated drinking vessel which expands and locks in place for drinking, and then collapsed down for easy transportation. The embodiment shown has three sections 4, 6, 8, which collapse into each other, but the design could have two or more collapsing sections. In other embodiments, the inventors envisage the vessel 2 having four of five collapsing sections. The volume of the vessel 2 when containing fluid is variable because the vessel 2 could be fully extended, or only partially extended. In addition, the vessel 2 could even carry a smaller volume of fluid when in the collapsed configuration. The silicone seals 28 ensure that no fluid leaks when in any configuration, thereby improving the safety of the vessel 2, especially if the fluid is a hot beverage or foodstuff, the thermal effect of which can cause small expansions/contractions on the vessel 2.

The locking mechanism 50, 60 means that the vessel 2 is held securely in an expanded configuration, and the mechanism allows the sections to be expanded and locked using a quick pull and twist motion. The guide marks 80 on the side of each section of the vessel 2 are provided to show when the locking mechanism has been secured. The inventors have managed to create a vessel 4 which is made of an outer stainless steel shell 22 which has been press-fitted to a plastic inner shell 26 with the section separated by silicone rings 28 to allow easing opening and closing.

The invention claimed is:

1. A collapsible vessel for containing fluid, the vessel comprising at least two interconnected tubular sections which are configured to move axially with respect to each other upon application of a substantially axial force thereto, such that the vessel is manipulatable between a collapsed configuration in which the sections are substantially nested to form a tube having a first length and an extended configuration in which the sections form a continuous tube having a second length which is greater than the first length, wherein each section comprises an inner wall and an outer wall, wherein the inner and outer walls are spaced apart with gas trapped in between the inner and outer wall of a section, and wherein at least one section comprises a circumferential ring which provides a seal between the inner wall of one section and the outer wall of an adjacent section, as the vessel is manipulated between the extended and collapsed configurations, wherein the vessel comprises locking means configured to be reversibly locked while the vessel is in the extended configuration upon the application of a rotational force to at least one section, wherein the locking means comprises one or more first locking members disposed on a first section, and one or more second locking members disposed on a corresponding location on an adjacent section, wherein each first locking member is configured to engage with each second locking member, to thereby lock the sections in the extended configuration, upon application of opposing rotational forces to each section, wherein each first locking member comprises a first moulding, which is attached to, and extends partially around the circumference of the lowermost portion of an inner facing surface of the section to which it is attached, wherein each first moulding comprises a body section from which extends an elongate overhanging finger, wherein the overhanging finger tapers radially inwardly to form a small recess, and tapers radially outwardly to create a terminal lug, and wherein each second locking member comprises a second moulding, which is attached to, and extends partially around the circumference of the uppermost portion of the outer facing surface of the section to which it is attached.

2. A vessel according to claim 1, wherein the vessel is a cup or mug.

3. A vessel according to claim 1, wherein the inner wall is substantially non-metallic, and the outer wall is substantially metallic.

4. A vessel according to claim 1, wherein (i) the sections of the vessel are substantially coaxial;

(ii) the vessel comprises at least two, at least three, at least four or at least five interconnected tubular sections;

(iii) the sections have different average or mean cross-sectional lengths, such that upon application of a substantially axial force thereto, a first section can fit into a second section when the vessel is in the collapsed or partially collapsed configuration; or (iv) the cross-section of the sections is oblong, rectangular, square, triangular or circular.

5. A vessel according to claim 1, wherein either: (i) the vessel comprises two tubular sections, and at least one circumferential ring disposed between the two sections to create a seal therebetween, as one section fits inside an adjacent section; or (ii) the vessel comprises three tubular sections, and at least two circumferential rings, wherein each ring is disposed between a pair of adjacent sections to create seals therebetween, as one section fits inside an adjacent section.

6. A vessel according to claim 1, wherein (i) each circumferential ring is disposed between an inner wall of one tubular section and an outer wall of an adjacent tubular section; (ii) each circumferential ring is disposed in or on an outer wall of a first tubular section or in or on an inner wall of a second tubular section, or in or on an inner wall of a first tubular section or in or on an outer wall of a second tubular section, wherein the first section is configured to fit inside the second section when the vessel is in the collapsed or partially collapsed configuration; or (iii) each circumferential ring is disposed on or in an outer wall of each section configured to fit inside an adjacent section.

7. A vessel according to claim 1, wherein an inner surface of the circumferential ring is disposed in a correspondingly shaped slot disposed in an outer wall of the section, thereby leaving an exposed surface of the ring which is configured to abut the inner wall of the adjacent section.

8. A vessel according to claim 1, wherein the circumferential ring comprises or consists of a resilient material, for example silicone or rubber.

9. A vessel according to claim 1, wherein the vessel comprises a removable lid which can be releasably attached to an open end of the section having a larger average or mean cross-sectional length, or wherein the vessel comprises guide means configured to indicate when the locking means is either engaged or disengaged.

10. A vessel according to claim 1, wherein each first and second locking members are configured to be disengaged from each other to unlock the sections upon application of a substantially rotational force in an opposite direction to that applied for locking to at least one section, or upon application of opposing rotational forces to each section, or in opposite directions to those applied for locking.

11. A vessel according to claim 10, wherein the locking means comprises a plurality of first locking members, wherein each one is circumferentially spaced apart along the circumference of the section.

12. A vessel according to claim 11, wherein the locking means comprises four spaced apart first locking members disposed at about 90° with respect to each other along the circumference of the section to which they are attached.

13. A vessel according to claim 10, wherein the locking means comprises a plurality of second locking members, wherein each one is spaced apart along the circumference of the section to which they are attached.

14. A vessel according to claim 13, wherein the circumferential ring is disposed spaced apart and above the second moulding, thereby creating a space therebetween.

15. A method of containing fluid, the method comprising inserting fluid into the vessel according to claim 1.

16. A vessel according to claim 3, wherein the inner wall comprises or is plastic, and the outer wall comprises or is stainless steel.

17. A vessel according to claim 7, wherein the exposed surface of the ring comprises a circumferentially extending groove.

18. A vessel according to claim 17, wherein the exposed surface of the ring comprises the circumferentially extending groove flanked on one or both sides by a circumferentially extending ridge.

19. A vessel according to claim 9, wherein the guide means is disposed on one or more of the sections, such that when the guide means on adjacent sections are aligned, they indicate that the locking means is engaged.

20. A vessel according to claim 11, wherein the locking means comprises at least two, at least three, or at least four spaced apart first locking members, and a corresponding number of second locking members.

21. A vessel according to claim 10, wherein an elongate slot extends partially around the circumference of the lowermost portion of the inner facing surface of the section to which the first moulding is attached, and is adjacent to, and substantially parallel with, the overhanging finger.

22. A vessel according to claim 13, wherein the locking means comprises at least two, at least three, or at least four spaced apart second locking members.

23. A vessel according to claim 22, wherein the locking means comprises four spaced apart second mouldings disposed at about 90° with respect to each other along the circumference of the section.

24. A vessel according to claim 14, wherein adjacent to the space, and circumferentially therealong, each second locking member comprises a protrusion, over which a lug of each first locking member can pass until it reaches, and is received by, the space.

25. A vessel according to claim 24, wherein when the lug is received by the space, the second moulding is received by a slot under an overhanging finger, and each first locking member and each second locking member mutually engage with each other, thereby locking the sections together.

* * * * *